United States Patent [19]

Rafferty

[11] Patent Number: 4,821,937

[45] Date of Patent: Apr. 18, 1989

[54] GUIDE FOR FASTENER DRIVING TOOL

[75] Inventor: John P. Rafferty, Vancouver, Wash.

[73] Assignee: Duo-Fast Corporation, Franklin Park, Ill.

[21] Appl. No.: 96,974

[22] Filed: Sep. 14, 1987

[51] Int. Cl.[4] ..... B27F 7/02

[52] U.S. Cl. ..... 227/8; 227/142

[58] Field of Search ..... 227/8, 130, 142, 156

[56] References Cited

U.S. PATENT DOCUMENTS 3,519,186 7/1970 Volkmann ..... 227/8

4,227,637 10/1980 Haytayan ..... 227/8

*Primary Examiner*—Frank T. Yost

*Assistant Examiner*—James L. Wolfe

*Attorney, Agent, or Firm*—Mason, Kolehmainen, Rathburn & Wyss

[57] ABSTRACT

A guide assembly mounted on a fastener driving tool locates the tool a predetermined distance from the edge of hardboard siding or a similar workpiece and assures that a fastener is driven into the workpiece the correct distance. The tool includes a housing having a nose defining a drive track and a driver blade for driving fasteners along the drive track into the workpiece. A safety member moves relative to the housing between a workpiece responsive position extending beyond the nose and an operating position, and a spring urges the safety member toward the workpiece responsive position. The guide assembly includes a yoke with a central portion adjustably mounted to the safety for controlling fastener penetration. A pair of laterally extending arms carry edge guides to locate the tool spaced from the workpiece edge in either of two different tool orientations. The edge guides are retractable so that one may be retracted when the other is used, or so that both may be retracted if neither is used. The edge guides are biased to a projecting position with a force smaller than the safety biasing spring force so that the guide assembly does not interfere with operation of the safety.

11 Claims, 2 Drawing Sheets

GUIDE FOR FASTENER DRIVING TOOL

The present invention relates to fastener driving tools and more particularly to a guide assembly for locating a power fastener driving tool relative to a workpiece.

BACKGROUND OF THE INVENTION

A typical pneumatic fastener driving tool includes a housing having a nose portion that is located relative to a workpiece at a position where a fastener, such as a nail, is to be driven. When the tool is placed against the workpiece, a movable safety member enables a drive stroke in which a driver blade drives a fastener along a drive track through the nose and into a workpiece. Usually the tool is designed so that the fastener penetrates fully into the workpiece with the head of the fastener countersunk to some degree.

Among the many uses to which fastener driving tools have been put is the installation of siding in the construction industry. Because of its advantages over conventional wood siding and other alternative materials, preformed hardboard siding is becoming more popular. Standard nailing techniques can lead to difficulty in the installation of hardboard siding. For example, countersunk fastener heads can cause fracturing of the fibers of the hardboard material at the exposed surface and a reduction in the life of the material or its surface finish may result. In addition, hardboard siding material is designed for optimum performance with fasteners installed a predetermined distance from the edge of the siding, and carefully controlled positioning is desirable.

A typical power fastener driving tool may cause difficulties in the installation of material such as hardboard siding because the tool cannot be controlled to precisely vary fastener penetration into the workpiece. In addition, the tool cannot readily be located at a precisely determined, optimum position relative to the siding material. While a simple, fixed edge guide might be employed, this approach would limit use of the tool to a single orientation relative to the workpiece and would prevent use of the tool for other purposes or at other locations on the workpiece.

SUMMARY OF THE INVENTION

It is a principal object of the present invention to provide a guide assembly for fastener driving tools capable of adjustably regulating the degree of fastener penetration into a workpiece while accurately locating the fastener without restricting tool orientation to a single choice. Other important objects of the invention are to provide a guide assembly suitable for use with widely used existing fastener driving tools; to provide a guide assembly capable of conveniently being mounted to the movable safety of a fastener driving tool without interfering with the operation of the safety or the tool; to provide a guide assembly that is adjustable for different degrees of fastener penetration; and to provide a guide assembly that can be associated with a fastener driving tool to overcome problems encountered in the installation of hardboard siding and similar materials.

In brief, the above and other objects of the invention are realized by providing a guide assembly for use with a fastener driving tool of the type including a housing having a nose defining a drive track and including a driver element for driving the fasteners in a given direction along the drive track into a workpiece. The tool employs a safety member carried by the housing for movement relative to the housing in the given direction between a workpiece responsive position and an operating position. Biasing means urges the safety toward the workpiece responsive position.

The guide assembly of the present invention includes a guide member and adjustable mounting means supporting the guide member adjacent the nose of the fastener driving tool for adjustably mounting the guide member in a selected one of a range of positions along the given direction for limiting the depth to which a fastener is driven into the workpiece. An arm extends from the nose in a direction transverse to the given direction, and an edge guide carried by the arm extends in the given direction beyond the safety member for locating the nose a predetermined distance from an edge of the workpiece.

DESCRIPTION OF THE VIEWS OF THE DRAWING

The present invention together with the above and other objects and advantages may best be understood from the following detailed description of the preferred embodiment of the invention illustrated in the accompanying drawings wherein:

FIG. 8 is a view similar to FIG. 2 showing a different adjusted position of the guide assembly.

DETAILED DESCRIPTION

Figure 1:
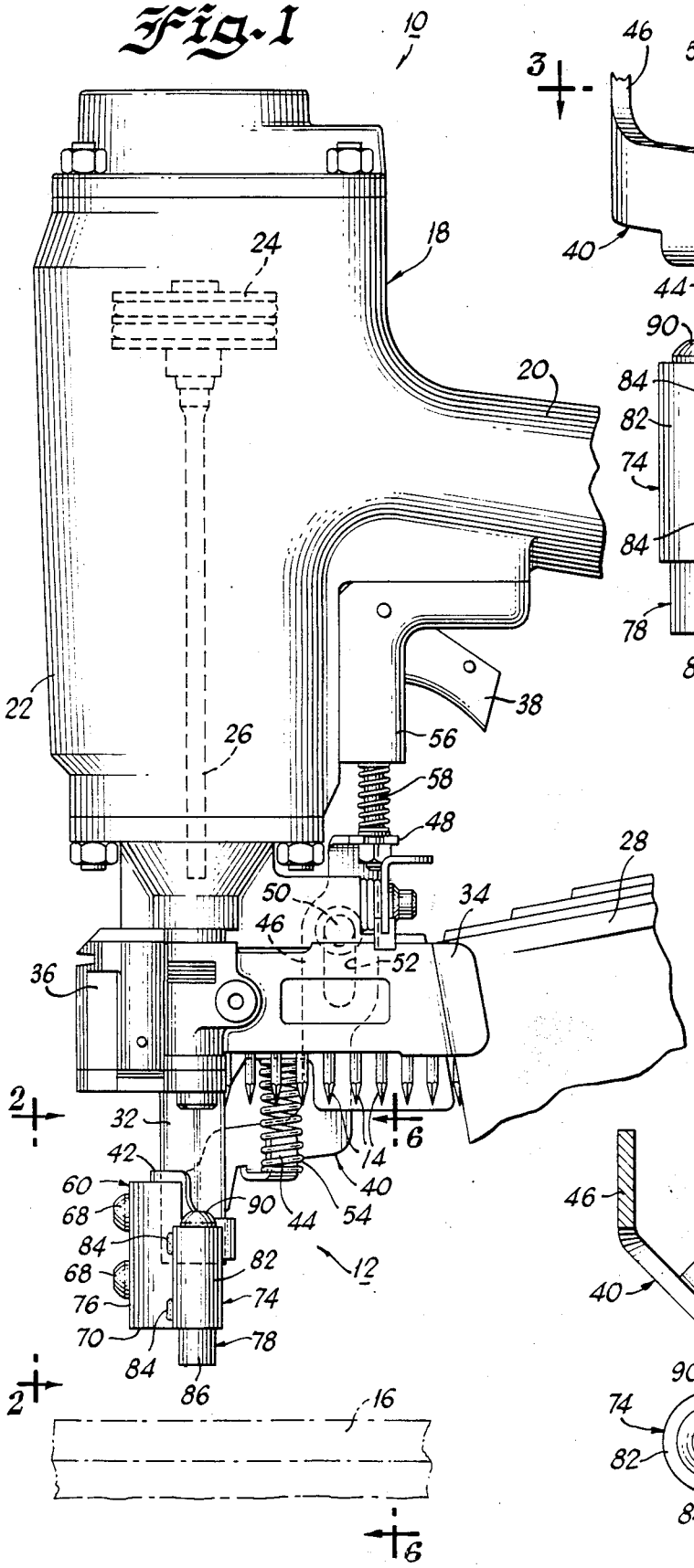
FIG. 1 is a side elevational view of portions of a fastener driving tool equipped with a guide assembly embodying the present invention.

Having reference now to the drawings, FIG. 1 shows a fastener driving tool generally designated as 10 equipped with a guide assembly generally designated as 12 and constructed in accordance with the principles of the present invention. The features of the present invention are applicable to many different types of fastener driving tools used with many different types of workpieces. The drawings illustrate the preferred embodiment in which tool 10 is a pneumatically powered tool for driving round head nails 14 into a workpiece 16 comprising prefabricated hardboard siding.

Tool 10 is shown in FIG. 1 in somewhat simplified and schematic form since additional details of the tool are not necessary to an understanding of the present invention. A housing 18 includes a handle 20 and a head portion 22 in which a piston 24 carrying a depending driver blade 26 is mounted for reciprocal movement in a fastener drive direction. A magazine 28 carries a supply of fasteners 14.

Figure 3:
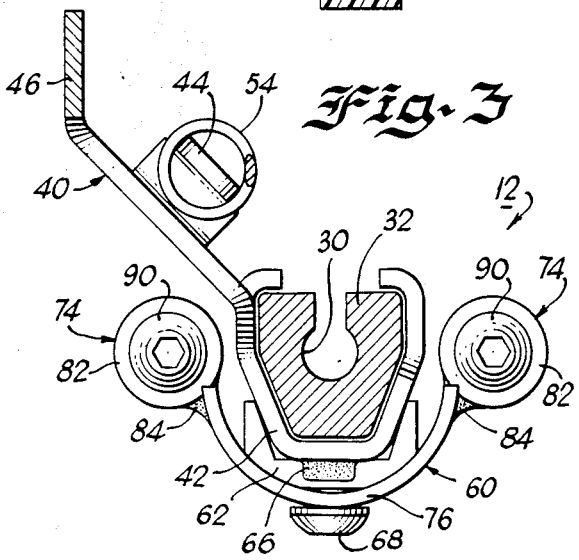
FIG. 3 is a sectional view taken along the line 3—3 of FIG. 2.

A fastener drive track 30 (FIG. 3) is defined in a nose 32 of the tool 10. A fastener feeding gate 34 is operated in synchronism with piston 24 to position a single fastener 14 in the drive track 30 prior to each drive stroke. Fasteners 14 may be supplied in collated form mounted along the length of a tape or carrier, and a tape guide 36 guides the tape away from tool 10 after fasteners have been driven therefrom.

Operation of the tool 10 in a fastener driving stoke is controlled by a trigger 38 and a safety 40. The safety includes a head portion 42, a bias spring mounting tab 44, a guide leg 46 and an actuating foot 48. Safety 40 is mounted on the housing 18 of tool 10 for limited movement in the fastener driving direction parallel to the drive track 30. Head portion 42 slidingly engages the nose 32 (FIG. 3) and a guide pin 50 fixed with respect to the housing 18 is slidably received in a slot 52 formed in the guide leg 46 of safety 40. A safety biasing spring 54 biases the safety to the normal, workpiece responsive position shown in FIG. 1 in which the nosepiece projects beyond the end of the nose 32.

A fastener driving stroke is initiated when safety 40 is moved to an alternate operating position and the trigger 38 is depressed. When the tool is pushed against the workpiece 16 with a force larger than the biasing force of the spring 54, the spring 54 is compressed and the actuating foot 48 moves toward a trigger base or housing 56. A rod 58 moves into the trigger base 56 and operates in conjunction with trigger 38 to control a pneumatic valve system to carry out a fastener drive stroke and a fastener feeding operation.

The preceding description of the fastener driving tool 10 is ample for a complete understanding of the present invention. For further details of operation of fastener driving tools of this type, reference may be had to the descriptions set forth in the following Unites States patents, each of which is incorporated here by reference.

U.S. Pat. No. 4,784,308 (patent application Ser. No. 847,726, filed Apr. 3, 1986) describes a pneumatic valving operation for carrying out a fastener driving stroke and a fastener feeding stroke in a pneumatic fastener driving tool. U.S. Pat. No. 3,543,987 and U.S. Pat. No. 4,319,705 describe pneumatically operated arrangements for feeding fasteners one at a time from a magazine to a fastener drive track in synchronism with operation of a fastener driving tool. U.S. Pat. No. 4,264,028 and U.S. Pat. No. 4,405,071 disclose arrangements for the operation of a fastener driving tool in response to actuation of a trigger and a safety.

Guide assembly 12 can readily be mounted to the tool 10 or other fastener driving tool either during original manufacture or by retrofitting. The assembly 12 includes a guide member in the form of a shoe or yoke 60 carried by the head 42 of safety 40. A mounting block 62 having a pair of tapped holes 64 is attached to the front of head 42 by welds 66. A pair of fasteners 68 are threaded into holes 64 to secure the member 60 in place.

In order to permit adjustment of the degree of fastener penetration, the member 60 is mounted for adjustment relative to the safety 40 and tool 10. When the tool is placed against workpiece 16, a bottom edge or surface 70 of member 60 engages the workpiece. When the tool is moved relative to the workpiece to displace the safety 40 and initiate a fastener driving operation, the distance between the end of nose 32 and the workpiece 18 is determined by the adjusted position of the member 60. The adjustment is provided by a pair of slots 72 in member 60 receiving the fasteners 68. The fasteners may be loosened and retightened with the member 60 in a selected position relative to the safety 40 and tool 10.

A pair of arms 74 extend laterally in opposite directions from a central portion 76 of member 60. Each arm carries a retractable edge guide 78 permitting the tool 10 to be accurately positioned with drive track 30 located a precisely determined distance from an edge 80 of workpiece 16.

Each arm 74 includes a cylinder or sleeve 82 attached by welds 84 to opposite edges of the central portion 76 of guide member 60. Sleeves 82 are each parallel to the drive track 30.

Figure 4:
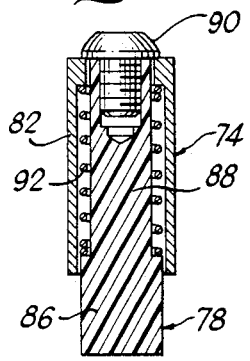
FIG. 4 is a sectional view taken along the line 4—4 of FIG. 2.

Each edge guide 78 is a generally cylindrical element having a head portion 86 and a shank 88 captured within the corresponding sleeve 82 by a fastener 90 (FIG. 4). Each edge guide 78 is biased outwardly from sleeve 82 by a guide biasing spring 92. When head portion 86 of an edge guide 78 is pushed against workpiece 16, the spring 92 contracts and the edge guide 78 retracts to the plane of the bottom edge 70 of the guide member 60. Preferably the edge guides 78 are formed of a low friction material such as plastic or the like and may rotate within the sleeve 82 to limit friction as the guides are moved along an edge 80 of workpiece 16.

Figure 6:
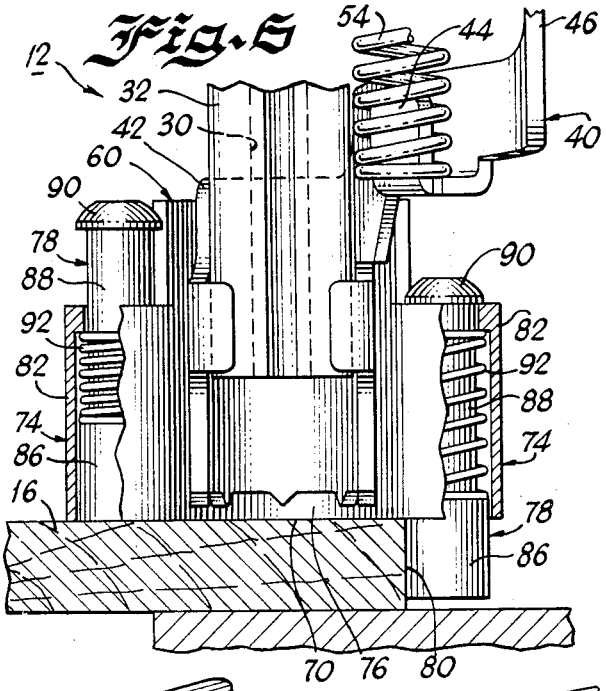
FIG. 6 is a view similar to FIG. 2 illustrating the guide assembly in position for driving a fastener into a workpiece.
Figure 7:
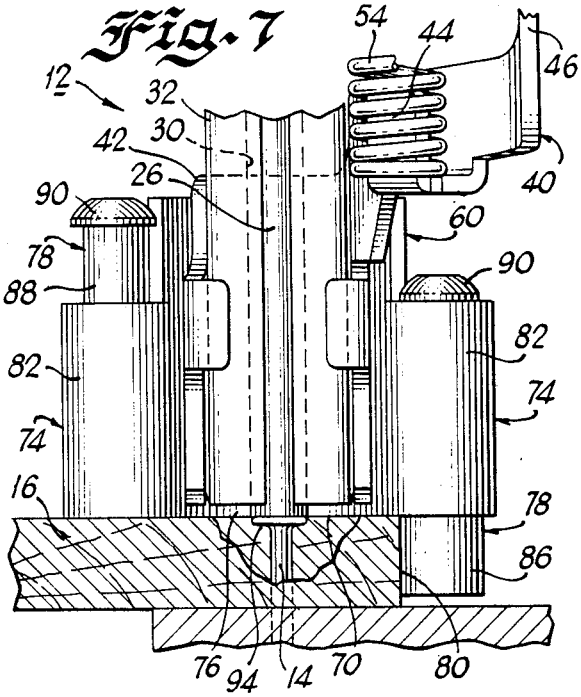
FIG. 7 is a view similar to FIG. 6 illustrating the completion of a fastener driving stroke.
Figure 5:
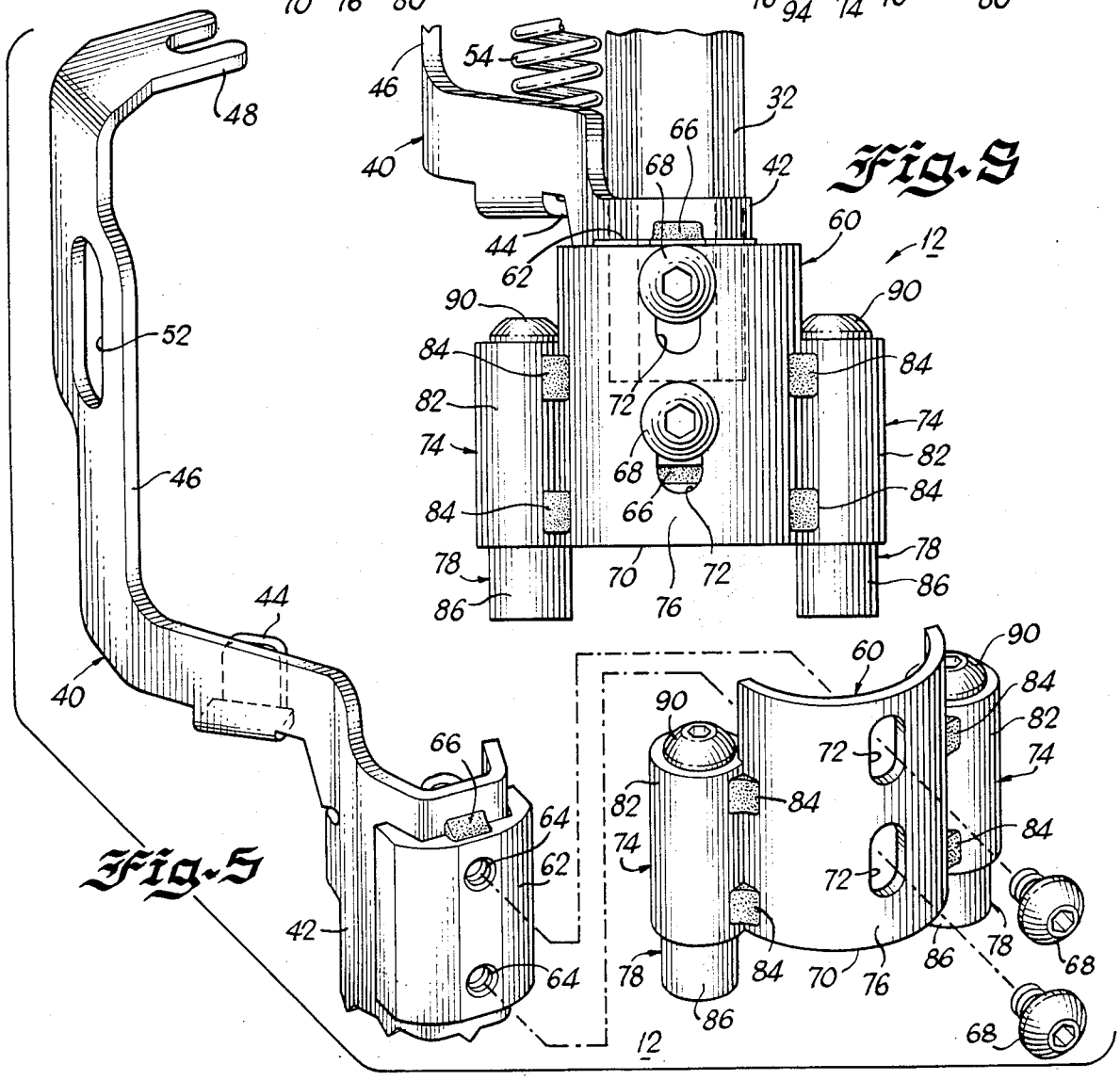
FIG. 5 is an exploded perspective view of components of the guide assembly.

Operation of the guide assembly 12 of the present invention appears in FIGS. 6 and 7. In order precisely to space a fastener from workpiece edge 80, the tool and guide assembly 12 are located as shown in FIG. 6. A selected one of the two edge guides 78 is in contact with the workpiece edge 80 and as a result the drive track 30 is precisely located a desired distance from the edge 80. Since two edge guides 78 are employed in a symmetrical configuration, the tool 10 may be held in the more convenient of two alternative orientations, one hundred eighty degrees apart. This feature is important in making the tool 10 with the guide assembly 12 convenient to use on a job site.

The guide biasing springs 92 have a smaller biasing force or spring force than the safety biasing spring 54. Thus, as seen in FIG. 6, the tool may be placed in position for operation without compression of the safety biasing spring 54 or movement of the safety 40 relative to the housing 18. Preferably, the springs 92 are selected so that both springs 92 may be fully compressed before compression of the safety biasing spring 54 occurs. This permits the tool to be used at any location on workpiece 16 without the guide assembly 12 interfering with operation of the tool or the safety 40.

After the tool 10 and guide assembly 12 are positioned in preparation for a drive stroke as illustrated in FIG. 6, the drive stroke may be initiated in the usual manner by pushing the tool against the workpiece to move the safety from the extended position on FIG. 6 to the operating position of FIG. 7, and by operation of trigger 38. The conclusion of a fastener driving stroke is shown in FIG. 7. The head 94 of fastener 14 is accurately driven flush with the surface of workpiece 16. In the case of hardboard siding, this flush penetration avoids problems that can arise in a countersunk installation due to exposed fractured fiber surrounding the fastener head. This accurate penetration is achieved by adjustment of the guide member 60 relative to the safety head 42 as described above.

Figure 2:
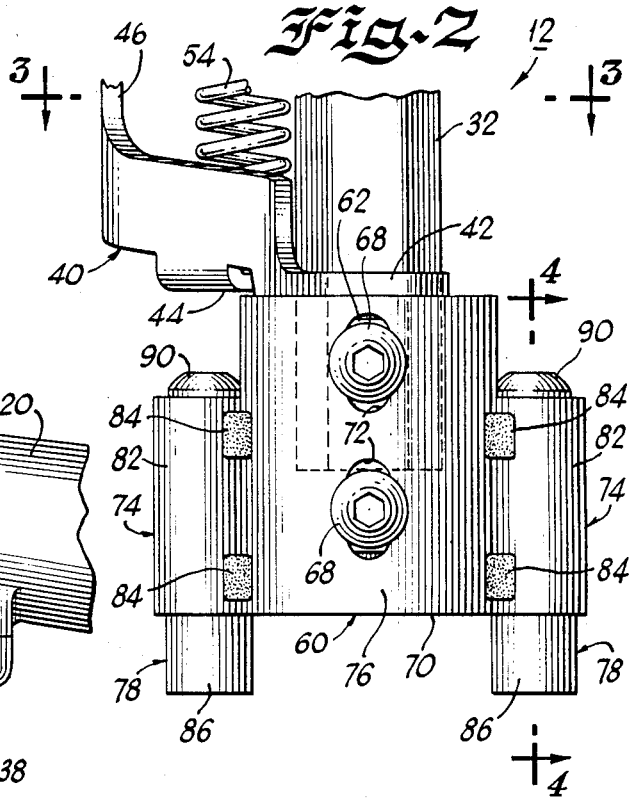
FIG. 2 is a fragmentary, front elevational view of the guide assembly taken from the line 2—2 of FIG. 1.

FIG. 8 in comparison with FIG. 2 illustrates a different adjusted position of the guide assembly 12. In FIG. 8 the guide assembly is adjusted to extend further from the tool 10 and the nose 32. When the tool 10 is operated with guide assembly 12 adjusted as shown in FIG. 8, a fastener 14 will penetrate less deeply into workpiece 16. Alternatively, the assembly 12 may be adjusted so that member 60 projects less far from nose 32 than shown in FIG. 2. This adjustment makes possible a countersunk installation of a fastener 14 into workpiece 16.

While the invention has been described with reference to details of the embodiments shown in the drawings, these details are not intended to limit the scope of the invention as defined in the following claims.

What is claimed and desired to be secured by Letters Patent of the United States is:

1. A fastener driving tool comprising;

a housing having a nose defining a drive track and having a driver element for driving fasteners in a given direction along said drive track into a workpiece;

a safety member carried by said housing for movement relative to said housing in said given direction between a workpiece responsive position extending beyond said nose and an operating position;

safety biasing means operatively connected between said housing and said safety member for urging said safety member toward the workpiece responsive position; and a workpiece responsive guide assembly for positioning the tool relative to a workpiece, said guide assembly characterized by:

a guide member;

adjustable mounting means supporting said guide member on said safety member adjacent said nose for adjustably mounting said guide member in a selected one of a range of positions arrayed in said given direction for limiting the depth to which a fastener is driven into a workpiece;

an arm extending from said nose in a direction transverse to said given direction;

an edge guide carried by said arm and extending in said given direction beyond said safety member for locating said nose a predetermined distance from an edge of the workpiece;

said edge guide being movably mounted on said arm and retractable in said given direction from a normal position to a retracted position to permit said nose to be located farther than said given direction from the edge of a workpiece; and guide biasing means operatively connected between said arm and said edge guide for biasing said edge guide to said normal position.

2. A fastener driving tool as claimed in claim 1, said guide biasing means having a smaller biasing force than said safety biasing means.

3. A fastener driving tool as claimed in claim 2, said safety biasing means comprising a mechanical spring.

4. A fastener driving tool as claimed in claim 1, said edge guide means being rotatable around an axis parallel to said given direction.

5. A fastener driving tool as claimed in claim 1, said guide assembly including two said arms extending in opposite directions, each arm including one said edge guide.

6. A fastener driving tool as claimed in claim 1, said guide assembly including two said arms extending in opposite directions, each arm including one said edge guide and guide biasing means, the total biasing force of said guide biasing means being smaller than the biasing force of said safety biasing means.

7. A guide shoe for a power fastener driving tool of the type including driver means for driving fasteners along a drive track from a nose into a workpiece, said guide shoe comprising:

a yoke adapted to be supported on the tool adjacent the nose;

said yoke including a laterally extending arm and a workpiece responsive portion;

adjustment means for adjusting the position of said workpiece responsive portion relative to the tool;

an edge guide mounted on said laterally extending arm and projecting beyond said workpiece responsive portion in the direction of the drive track; and mounting means for permitting said edge guide to move to a retracted position not extending beyond said workpiece responsive portion.

8. A guide shoe as claimed in claim 7, said yoke including two said arms extending in different directions and two said edge guides, each mounting on one said arm.

9. A guide assembly for a fastener driving tool of the type including a housing, means for driving fasteners from the housing into a workpiece in a drive direction, and a safety movable in said drive direction and biased with a predetermined force to a workpiece responsive position, said guide assembly comprising:

a yoke having a central portion and a pair of laterally extending arms;

adjustable mounting means for mounting said yoke in an adjusted position on the safety of the tool;

a pair of edge guides, one carried on each arm and extending in said drive direction beyond the central portion of said yoke; and retractable mounting means supporting said edge guides on said arms for permitting either edge guide to move to a retracted position relative to said central portion.

10. A guide assembly as set forth in claim 9, each said retractable mounting means including bias means urging each said edge guide away from said retracted position.

11. A guide assembly as set forth in claim 10, said bias means having a biasing force smaller than said predetermined force.

* * * * *